US007338385B2

(12) United States Patent
Nguyen

(10) Patent No.: US 7,338,385 B2
(45) Date of Patent: Mar. 4, 2008

(54) GOLF ASSISTING DEVICE

(76) Inventor: Hien M. Nguyen, 12542 Leaders St., Houston, TX (US) 77072

( * ) Notice: Subject to any disclaimer, the term of this patent is extended or adjusted under 35 U.S.C. 154(b) by 9 days.

(21) Appl. No.: 11/267,120

(22) Filed: Nov. 5, 2005

(65) Prior Publication Data

US 2007/0111812 A1 May 17, 2007

(51) Int. Cl.
*A63B 69/36* (2006.01)

(52) U.S. Cl. ..... 473/182; 473/164

(58) Field of Classification Search ..... 473/157–164, 473/166, 171–174, 180–194
See application file for complete search history.

(56) References Cited

U.S. PATENT DOCUMENTS 3,065,971 A * 11/1962 Coles ..... 473/182
3,171,657 A * 3/1965 Strang ..... 473/182
3,342,495 A * 9/1967 Wasley ..... 473/164
4,368,888 A * 1/1983 Ren ..... 473/164
4,875,682 A * 10/1989 Paolillo ..... 473/157
4,886,274 A * 12/1989 Park ..... 473/164
5,209,484 A * 5/1993 Randall ..... 473/265
5,261,670 A * 11/1993 Mull ..... 473/182
5,282,626 A * 2/1994 Millar ..... 473/174
5,351,960 A * 10/1994 Knapp ..... 473/182
5,720,667 A * 2/1998 Tu ..... 473/162
6,461,247 B1 * 10/2002 Riddell ..... 473/219
2005/0032580 A1 * 2/2005 Rango ..... 473/164

* cited by examiner

*Primary Examiner*—Mark S. Graham

(57) ABSTRACT

The present invention is a putting tool to assist a golfer. The putting tool comprises a box like structural housing having a cavity therein. The housing is further defined by a top wall, bottom wall, back wall, first side wall, and an opposing second side wall. The front of the housing defines an opened an entry way for inserting foam into the cavity of the housing. An elastic band covers the front opening of the housing. At a predetermined location on the elastic band, a target is incorporated onto the band. Thus, when the golf ball hits the elastic band, the ball bounces off the band and automatically returns back to the putter.

13 Claims, 3 Drawing Sheets

GOLF ASSISTING DEVICE

BACKGROUND

The present invention relates to a tool to assist a golfer in practicing putting. Golf is a very popular game. Golf is an outdoor game in which individual players use specially designed clubs to propel a small, hard ball over a field known as a course. The course normally consists of 18 holes. The object of the game is to advance the ball around the course using as few strokes as possible. To facilitate the practice of their games many golfers use putting practice tools. In the prior are there are several tools to assist golfers. For example, U.S. Pat. No. 3,700,243 disclose a putting tool in the form of a box structure with a hole in the middle with an incline attached to the middle to assist the ball into the hole. The present invention provides a uniquely designed tool to assist a golfer in developing their game.

SUMMARY

One of the main objectives of the present invention is to provide a simple effective putting device to help golfers enhance their game off of the course. The present invention is a putting tool to assist a golfer. The putting tool comprises a box like structural housing having a cavity therein. The housing is further defined by a top wall, bottom wall, back wall, first side wall, and an opposing second side wall. The front of the housing defines an opened an entry way for inserting foam into the cavity of the housing. An elastic band covers the front opening of the housing. At a predetermined location on the elastic band, a target is incorporated onto the band. Thus, when the golf ball hits the elastic band, the ball bounces off the band and automatically returns back to the putter.

The invention includes other features and advantages which also enhance its ability to be quite useful and attractive. Such features and advantages will become apparent from the drawings in conjunction with the detailed description.

DETAILED SPECIFICATIONS

Figure 1:
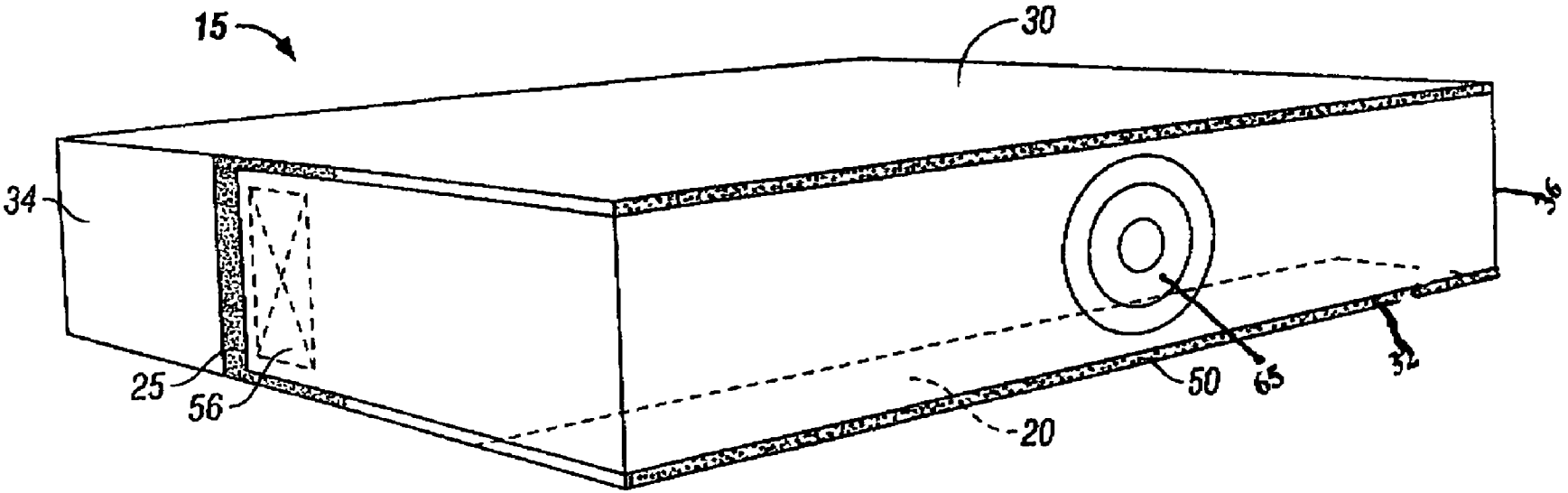
FIG. 1 is a frontal perspective view of the putting device of the present invention.
Figure 2:
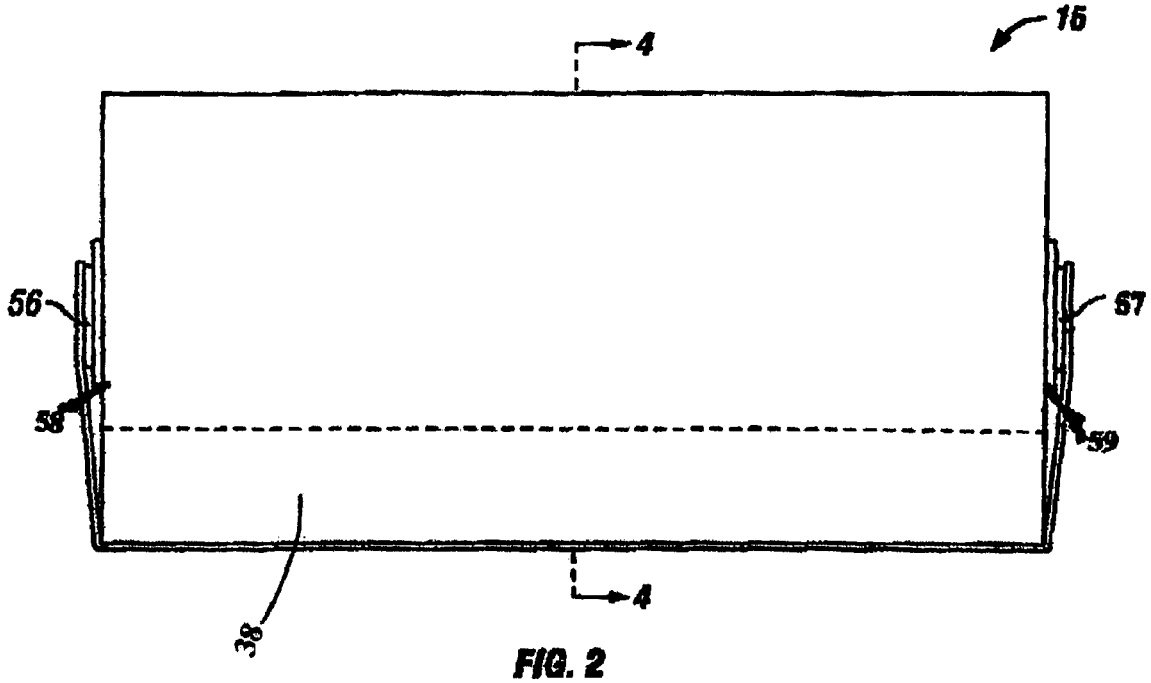
FIG. 2 is a top perspective view of the present invention.
Figure 4:
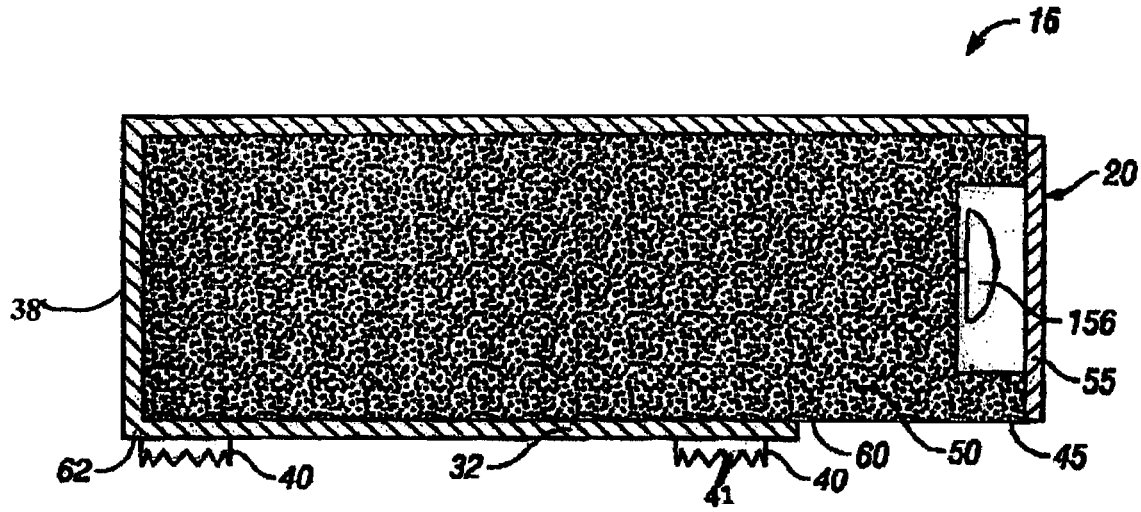
FIG. 4 is a cross-sectional view of the embodiment illustrated in FIG. 2.

Referring to FIGS. 1, 2, and 4 there is shown, one embodiment of the present invention, a golf putting device, shown generally as 10 which includes housing 15, cushioning material 50, and target return member 20.

Housing 15 further comprises a box like structure defining interior cavity 25 therein. Housing 15 further includes a plurality of interconnected walls—top wall 30, bottom wall 32, side wall 34, opposing side wall 36, and back wall 38. Referring to FIG. 4, attached to the underside of bottom wall 32 is a plurality of leg members 40. Leg members 40 provide support to housing 15 when generally placed on a substantially flat surface area. Additionally, the underside of each leg member 40 is adapted with a friction absorbing material 41 to prevent the housing 15 from moving during putting practice.

The front of housing 15 is opened to define an entry way 45 into interior cavity 25. To absorb the force of the golf ball during putting practice, cushioning material 50 is inserted into interior cavity 25 through entry way 45. The entire area of cavity 25 is filled with cushioning material 50 dimensioned to fit the entire space inside interior cavity 25. Cushioning material 50 can be made from a flexible polyurethane plastic material, another foam or sponge like material.

Target return member 20 further comprises an elastic band 55 removably secured in place over entry way 45. Opposing fasteners 56, 57 are attached to each side of elastic band 55. Complimentary mating fasteners 58, 59 are attached to the external wall of side wall 34 and opposing side wall 36 for respective engagement with opposing fastener 56, 57. Opposing fasteners 56, 57 and complementary mating fasteners 58, 59 are preferably made of VELCRO. However, another suitable connection method can be utilized such as hook and catch mechanism. As shown incorporated approximately near the center of target return member 20 can be indicia means 65 representing the putting target for a user during putting practice. In the preferred embodiment one circle having approximately the same diameter of a golf ball is incorporated near the center of band 55. However, the present invention is not limited to one target indicia means 65.

Referring to FIG. 4, there is shown a cross-sectional view of one embodiment of the present invention. As shown, bottom wall 32 has a smaller area than top wall 30. Bottom wall 32 further includes a front edge 60 and a back edge 62. Near entry way 45 along front edge 60, a portion of the surface area of bottom wall 32 is cut away allowing the exposure of cushioning material 50. In use, band 55 in conjunction with the exposure of cushioning material 50 facilitates the golf ball return. As the ball hits band 55, the force of the ball compresses the band against cushioning material 50 creating a bounce effect to facilitate the return of the golf ball.

Figure 3:
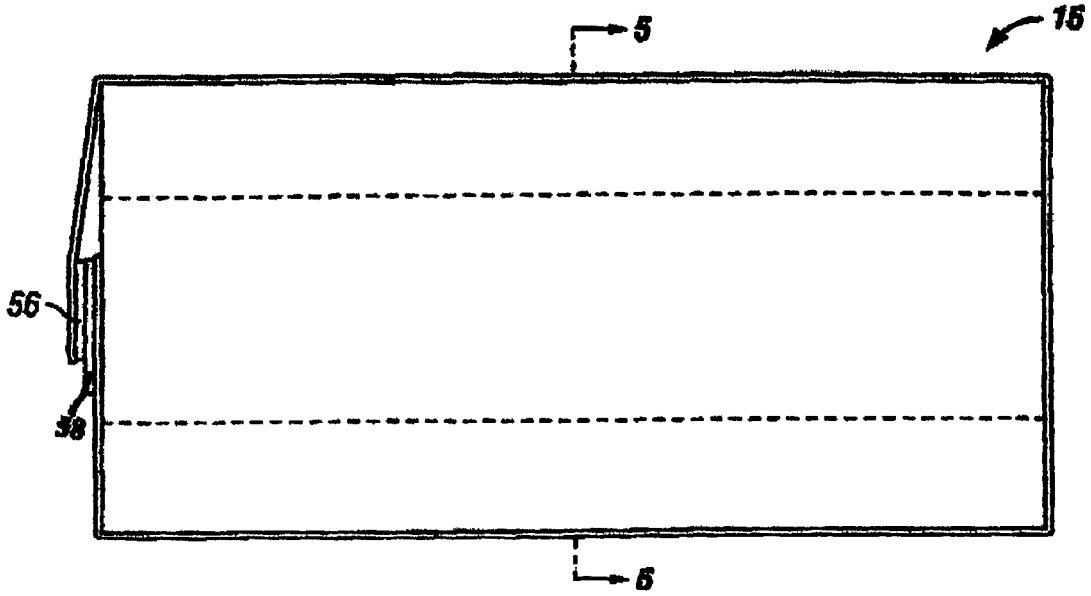
FIG. 3 is top perspective view of an alternative embodiment of the present invention.
Figure 5:
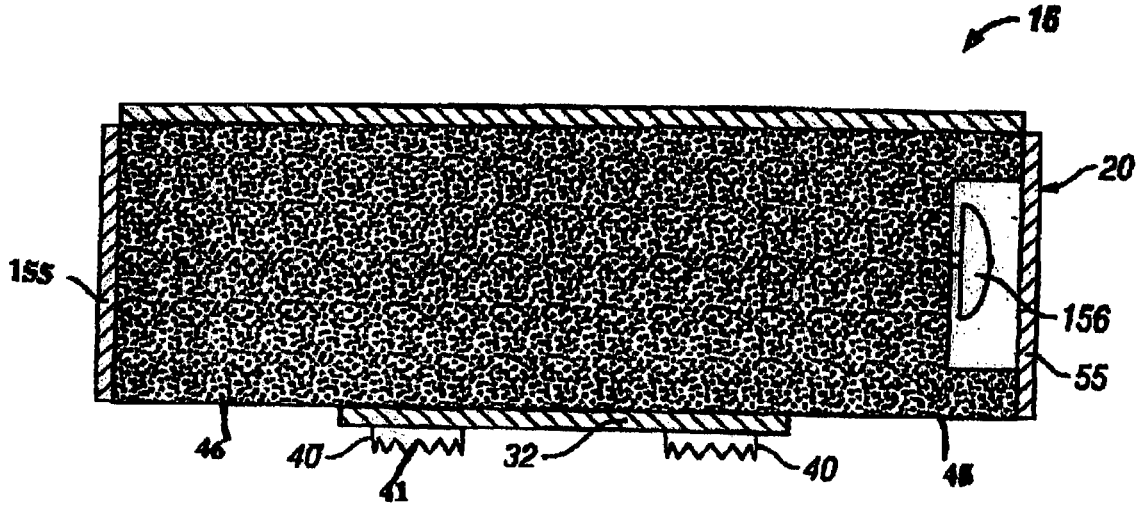
FIG. 5 is a cross-sectional view of the alternative embodiment illustrated in FIG. 3.

FIGS. 5 and 3 illustrate an alternative embodiment of the present invention. In this alternative embodiment, housing 15 further comprises a box like structure defining interior cavity 25 therein. Housing 15 further includes a plurality of interconnected walls—top wall 30, bottom wall 32, side wall 34, and opposing side wall 36. Attached to the underside of bottom wall 32 is a plurality of leg members 40. Leg members 40 provide support to housing 15 when generally placed on a flat floor surface area. Additionally, the underside of each leg member 40 is adapted with a friction absorbing material to prevent the housing 15 from moving during putting practice.

The front and back of housing 15 are opened to define front entry way 45 and back entry way 46 into interior cavity 25. To absorb the force of the golf ball during putting practice, cushioning material 50 is inserted into interior cavity 25 through entry way 45 or back entry way 46. The entire area of cavity 25 is filled with cushioning material 50 dimensioned to fit inside of interior cavity 25. Cushioning material 50 can be made from a flexible polyurethane plastic material, another foam or sponge like material.

Target return member 20 further comprises an elastic band 55 removably surrounding front entry way 45, back entry way 46, side wall 34 and opposing side wall 36. Alternatively target return member 20 can further comprise a front elastic band 55 removably secured in place over entry way 45, and a back elastic band 155 removably secured in place over back entry way 46 by suitable fastening means as described above.

Referring to FIG. 5, there is shown a cross sectional view of an alternative embodiment of the present invention. As shown, in this configuration the bottom wall is cut away at the front and back such that bottom wall 32 has a smaller surface area than top wall 30. Additionally, back wall 38 is removed. Bottom wall 32 is further defined by a front edge 60 and a back edge 62. Near front entry way 45 along front edge 60, a portion of the surface area of bottom wall 32 is cut away allowing the exposure of cushioning material 50 along the front side. Near back entry way 46 along back edge 62, a portion of the surface area of bottom wall 32 is cut away allowing the exposure of cushioning material 50 along the back side. In use, frontal band 55 in conjunction with the exposure of cushioning material 50 facilitates the golf ball return. As the ball hits frontal band 55, the force of the ball compresses the band against cushioning material 50 creating a bounce effect to facilitate the return of the golf ball. As the ball hits back band 155, the force of the ball compresses the band against cushioning material 50 creating a bounce effect to facilitate the return of the golf ball.

In both embodiments, as shown in FIGS. 4 and 5 at least one sounding device 156 such as a bell can be mounted into cushioning means 50 behind target return member 20 at a strategic location. In the preferred embodiment, sounding device 156 is mounted behind a target indicia means. In use, when the golf ball hits the cushioning means 50, the force of the ball striking target return member 20 causes the sounding device 156 to be activated. In the embodiment, illustrated in FIG. 5 the sounding device can be inserted into cushioning means 50 behind the target return member 20 across back entry way 46.

In yet, some other embodiments, the back wall 38 and the portion of the bottom wall 32 against back edge 62 can be removable and reattached. With this embodiment, the device becomes interchangeable between the configuration illustrated in FIG. 4 and FIG. 5.

What is claimed is:

1. A golf putting device comprising:

a polygonal shape housing defining an interior cavity therein, the housing further comprising a plurality of interconnected walls including a top wall, a bottom wall, a first side wall, an opposing second side wall, and a back wall;

an entry way into the interior cavity extending from the first side wall to the opposing second side wall opposing the back wall;

cushioning means filing the interior cavity;

a band of elastic material dimensioned to cover the entry way, the band extending from the first side wall to the opposing second side wall, the band being removably connected to the side wall at a first end and removably connected to the opposing side wall at an opposing second end such that the force of a golf ball striking the band against the cushioning material causes a bouncing effect to automatically return the golf ball to a putter.

2. The putting device of claim 1 further comprising:

at least one indicia means incorporated into the band at a strategic location;

the at least one indicia means representing a target for a user to aim for during putting practice.

3. The putting device of claim 2 wherein the indicia means is a circle having substantially the diameter of a golf ball.

4. The putting device of claim 1 further comprising at least one leg member affixed to an underside of the bottom wall.

5. The putting device of claim 4 wherein the at least one leg member further comprises an underside covered with a friction absorbing material wherein the housing is prevented from moving during putting practice.

6. The putting device of claim 1 wherein the bottom wall further comprises: a bottom surface area, a front edge and a back edge;

a portion of the bottom surface area being cut away along the front edge of the back wall exposing a portion of the cushioning material such that when a golf ball strikes the band against the cushioning material the force of the ball causes a bouncing effect which returns the golfball.

7. The putting device of claim 6 further comprising:

the back wall is removed to define a second entry way;

the second entry way extending from the extending from the first side wall to the opposing second side wall opposing the first entry way;

a second band of elastic material dimensioned to cover the entire second entry way, the band extending from the side wall to the opposing side wall, the band being removably connected to the side wall at a first end and removably connected to the opposing side wall at an opposing second end a second portion of the bottom surface area being removed along the back edge of the back wall exposing the cushioning material such that the force of the ball striking the second band against the cushioning material causes a bouncing effect to automatically return the golfball to a putter.

8. The putting device of claim 1 wherein at least one sounding device is mounted at a strategic location within the cushioning material behind the band.

9. The putting device of claim 7 wherein at least one sounding device is mounted as a strategic position within the cushioning material behind the second band.

10. The putting device of claim 7 wherein the back wall can be removed and reattached.

11. The putting device of claim 7 wherein the second portion can be removed and reattached.

12. A golf putting device comprising:

a housing defining an interior cavity therein, the housing further comprising a plurality of interconnected walls including a top wall, a bottom wall, a side wall, an opposing side wall, and a back wall;

an opened front wall forming an entry way into the interior cavity;

cushioning means filling the interior cavity;

a band of elastic material dimensioned to cover the entire entry way, the band extending from the side wall to the opposing side wall, the band being removably connected to the side wall at a first end and removably connected to the opposing side wall at an opposing second end such that the force of a golf ball striking the band against the cushioning material causes a bouncing effect to return the golf ball;

at least one indicia means incorporated into the band at a strategic location;

the at least one indicia means representing a target for a user to aim for during putting practice;

the entry way opening extending from the side wall to the opposing side wall;

at least one leg member affixed to an underside of the bottom wall; and the at least one leg member further comprising an underside covered with a friction absorbing material preventing the moving of housing when placed upon a substantially flat surface.

13. A golf putting device comprising:

a housing defining an interior cavity therein, the housing further comprising a plurality of interconnected walls including a top wall, a bottom wall, a side wall, an opposing side wall;

an opened front wall forming a first entry way into the interior cavity; the first entry way extending from the side wall to the opposing side wall;

an opened back wall forming a second entry way into the interior cavity, the second entry way extending from the side wall to the opposing side wall; cushioning means filling the interior cavity;

a band of elastic material dimensioned to surround the first entry way, the second entry way, the side wall and the opposing side wall such that the force of a golf ball striking the band against the cushioning material causes a bouncing effect to return the golf ball;

at least one indicia means incorporated into the band at a strategic location; the at least one indicia means representing a target for a user to aim for during putting practice;

at least one leg member affixed to an underside of the bottom wall; and the at least one leg member further comprising an underside covered with a friction absorbing material preventing the moving of housing when placed upon a substantially flat surface.

* * * * *